US005127591A

United States Patent [19]

Bernhard et al.

[11] Patent Number: 5,127,591

[45] Date of Patent: Jul. 7, 1992

[54] APPARATUS FOR CRUSHING OR GRINDING OF FIBROUS MATERIAL, IN PARTICULAR DRUM REFINER

[75] Inventors: Emmerich Bernhard; Johann Lileg; Johannes Kappel; Dag Bergloff; Bernhard Rebernik, all of Graz, Austria; Sven-Erik Henriksson, North Vancouver, Canada

[73] Assignee: Maschinefabrik Andritz Actiengesellschaft, Graz, Austria

[21] Appl. No.: 625,267

[22] Filed: Dec. 10, 1990

Related U.S. Application Data

[63] Continuation of Ser. No. 267,473, Nov. 4, 1988, abandoned.

[30] Foreign Application Priority Data

Nov. 5, 1987 [AT] Austria ..... 2924/87

[51] Int. Cl.[5] ..... B02C 19/00

[52] U.S. Cl. ..... 241/259.1; 241/261.1; 241/261.2; 241/294

[58] Field of Search ..... 241/259.1, 244, 259.2, 241/261.2, 261.1, 261.3, 294

[56] References Cited

FOREIGN PATENT DOCUMENTS 276356 7/1928 United Kingdom ..... 241/243

2083375 3/1982 United Kingdom ..... 241/261.2

*Primary Examiner*—Mark Rosenbaum

*Attorney, Agent, or Firm*—Seidel, Gonda, Lavorgna & Monaco

[57] ABSTRACT

A drum refiner for grinding fibrous material, preferably chips, has an engine-driven drumshaped rotor which is placed on a horizontal shaft. The rotor has grinding surfaces extending parallel to the rotor axis and corresponding opposing grinding surfaces arranged on the housing. The grinding elements are placed symmetrically about at least one material feeds which are conveniently evenly distributed around the circumference of the rotor. The grinding surfaces begin parallel to the axis and contiguously increasing in inclination forming a grinding gap inclined towards the rotor axis at an angle of approximately 5° to 45°, preferably 15°. The second embodiment includes grinding surfaces contiguously increasing in inclination and ending with an angle of inclination of approximately 90° to the rotor axis.

53 Claims, 6 Drawing Sheets

A
B
1
2
3
4
5
6
7
7'
8
9
9'
10
11
12
14
16
17
18

APPARATUS FOR CRUSHING OR GRINDING OF FIBROUS MATERIAL, IN PARTICULAR DRUM REFINER

This application is a continuation of Ser. No. 07/267,473 filed on Nov. 4, 1988, now abandoned.

The invention relates to a drum refiner for grinding fibrous material, particularly chips. The drum refiner comprises an engine-driven drumshaped rotor which has at least two rotating grinding surfaces which are frustoconical and parallel to the rotor axis. The rotor is placed on a horizontal shaft inside a housing which has opposing grinding surfaces on its inner walls at an angle with respect to the rotor face. At least one mechanical feed is directed radially to the rotor axis and tangential to the housing shell and positioned in the center of the housing. Symmetrically on both sides of the mechanical feed are the grinding surfaces of the rotor and the housing shell. The grinding elements on the surface are arranged so that the gaps between them increase in diameter in a direction away from the mechanical feed. In the first embodiment, grinding surfaces form a gap of an angle of approximately 5° to 45° at the rotor axis. In the second embodiment the grinding surfaces form a gap at an angle of almost 90° with respect to the rotor axis.

Most prior art refiners are used for the mechanical production of wood pulp. They comprise a disk equipped with grinding plates rotating about a horizontal axis. An opposing disk corresponding with this disk is also provided with grinding plates which can be either rotating or stationary. In these known embodiments, at least an essential portion of the grinding gap extends vertically or inclined towards the axis of rotation in the area of the marginal zone. Since high contact pressure of the grinding plates is required for the grinding operation, the aforementioned known embodiment causes excessive stress on the material and above all on the bearings. This means that the maximum admissible refiner throughput is limited. The resulting use of high mechanical energy causes the generation of considerable amounts of steam in the grinding gap because mainly wet or humid material is ground. For a good utilization or recovery of energy and a largely unhampered charging of the chips or the like, an adequate discharge of the steam together with the fibrous material thus produced or recovered is aimed at, but difficult to put into practice because of the large amount of steam generated. Particularly aggravating is the vertical arrangement of the grinding gap in conventional disk refiners, as these bring about a partial separation of the fibrous material and a strong backflow of the generated steam.

The invention thus aims at the following objects: Reduction of the material stress, a decrease of bearing stress, an increase of material throughput and an increase of the number of revolutions per minute of the rotor or shaft as well as an improvement of the problem cause by steam generation and steam discharge.

These objects are achieved according to the invention initially mentioned herein, by providing grinding surfaces on the rotor shell starting parallel to the rotor axis and contiguously increasing in inclination as compared to the rotor axis. Opposing grinding surfaces to the rotor grinding surfaces are arranged on the housing. The rotor grinding surface forms an inclined grinding gap extending parallel to the rotor axis which then contiguously inclines with respect to the rotor axis.

The opposing grinding surface is disposed symmetrically with respect to the median plane of at least one, preferably two or more material feed(s) evenly distributed over the circumference of the rotor. The rotor grinding surfaces are frustoconical and inclined at an angle of approximately 5° to 45°, preferably 15°, to the rotor axis. A second embodiment comprises the inclined grinding surfaces contiguous with a grinding surface with an angle of inclination of approximately 90°. The embodiments of the grinding surfaces according to the invention assures a particularly effective defibration and simultaneous promotion of the steam discharge, as well as reduction of material stress, decrease of bearing stress, increase of material throughput and increase of the number of revolutions per minute. This is possible because of the precrushing of the material in the grinding gaps parallel to the axis and the contiguous transition of said grinding gaps to the opposing grinding gaps at an angle of inclination relative to the axis particularly facilitating the crushing operation. This facilitation is further enhanced by the fact that the opposing crushing surfaces are arranged on one or two stator rings displaceable independently of one another. Refiners according to the invention are particularly suitable for the production of TMP (thermomechanical pulp) and CTMP (chemical thermomechanical pulp). According to the invention, the radially fed chips or the like, advantageously having been precrushed in the horizontal grinding gap previously, are distributed symmetrically in both directions, whereupon a particularly effective defibration of the wood or the like is effected in the adjacent inclined conical grinding gap causing the discharge of the steam to be enhanced.

The distribution of the chips can be particularly influenced if the inclined grinding gaps are adjustable. For this purpose, opposing grinding surfaces are provided on one or two stator rings arranged horizontally displaceable independently of one another in the housing. The adjustment of the grinding gap is important for the control of the properties of the pulp.

A convenient adjustment of the grinding gap can also be achieved by providing a single displaceable stator ring for the rotor to be supported on both sides by its bearings displaceably and preferably floatingly. For forming such a floating support, the rotor can conveniently be axially displaceably supported in a hydrostatic sliding bearing with a sealing unit enclosing the rotor shaft in the bearing housing between said sliding bearing and the interior of the housing receiving the rotor. The material feed is particularly effected if an annular material feed gap is connected to an annular space enclosing the outside of the rotor within the housing. The tangential or approximately radial material feeds empty into the cross-axial median plane of the refiner between the grinding surfaces parallel to the axis. According to an additional embodiment of the invention, cavities into which the conical or normally extending grinding gaps empty are provided in the area of the two housing front walls closest to the shaft bearings of the rotor. These are provided with opposing grinding surfaces which are either inclined to the axis or extend normally to the axis. The grinding stock is thus conveyed to the inner spaces of the housing of the refiner and can thus be discharged together with the generated steam. The discharge of the steam is thus facilitated. In view of the generation of steam, the aforementioned cavities are conveniently sealed against the penetration of steam into the two bearings by the special sealing units inserted between rotor and bearings in the bearing housing on the side of the rotor. These cavities are conveniently provided on the bottom with discharge openings for comminuted material.

In practice, a particularly convenient solution is obtained if the drumshaped rotor provided on its jacket with grinding surfaces and its opposing grinding surfaces are supported by the sliding bearings by means of a fixedly attached rotary shaft and a special starting engine, in particular a direct current engine. The special engine is provided for the starting operation, and the main engine is set up for an operation of about 3,000 to 3,600 rpm at full load. The starting engine can be provided on a free end of the stator shaft; it requires an essentially lower output than the main engine requires for the operation of the crushing apparatus, thus reducing the starting current peak. This embodiment makes it possible to operate large refiners with up to 3,600 rpm.

Instead of frustoconical grinding gaps adjacent the opposing grinding gaps, it would also be possible to provide gaps of a different shape such as rotation paraboloids, rotation hyperboloids or the like, although the diameters of these surfaces must constantly increase, from the junction to the opposing grinding surfaces in order to assure the desired effects for the passing of the materials.

A refiner is known per se in which a conical trunnion is provided on its periphery with crushing bars of varying lengths and arranged in the conical interior space of a housing whose interior wall is provided with corresponding opposing bars so that a grinding gap of 1 to 2 mm dimension results. The material feed is effected on one side of the machine within the area of the trunnion shaft. The output of this refiner is unsatisfactory because the material feed is effected from only one side and immediately on the shaft directed into the conical grinding gap. There is no satisfactory defibration and no adequate pulping effect. This also applies in a similar manner to the known conical refiners.

Also belonging to the state of the art is a microatomizer in which grinding stock is fed centrally from the top via a screw conveyor to hollanders extending parallel to the axis of a separator impeller wheel, the hollanders forming a gap extending parallel to said axis with the housing receiving said impeller wheel which is provided with small notches on its inner wall. The grinding stock ground in the parallel gap is conveyed toward the center of the grinding zone by an air stream and in doing so passes said separator impeller wheel. The coarse grinding matter separated therein is returned to the grinding zone. Two blower wheels arranged on both sides of the grinder shaft generate the required air stream. Aside from the fact that in this known embodiment, there are no conical grinding gaps or the like adjacent the grinding gaps parallel to the axis, it is not suitable for processing chips or other wet fibrous material, not to mention its elaborate construction.

The invention is explained in the following by means of exemplary embodiments of a drum refiner to the production of wood pulp from chips, under reference to the accompanying drawings, wherein.

Figure 1:
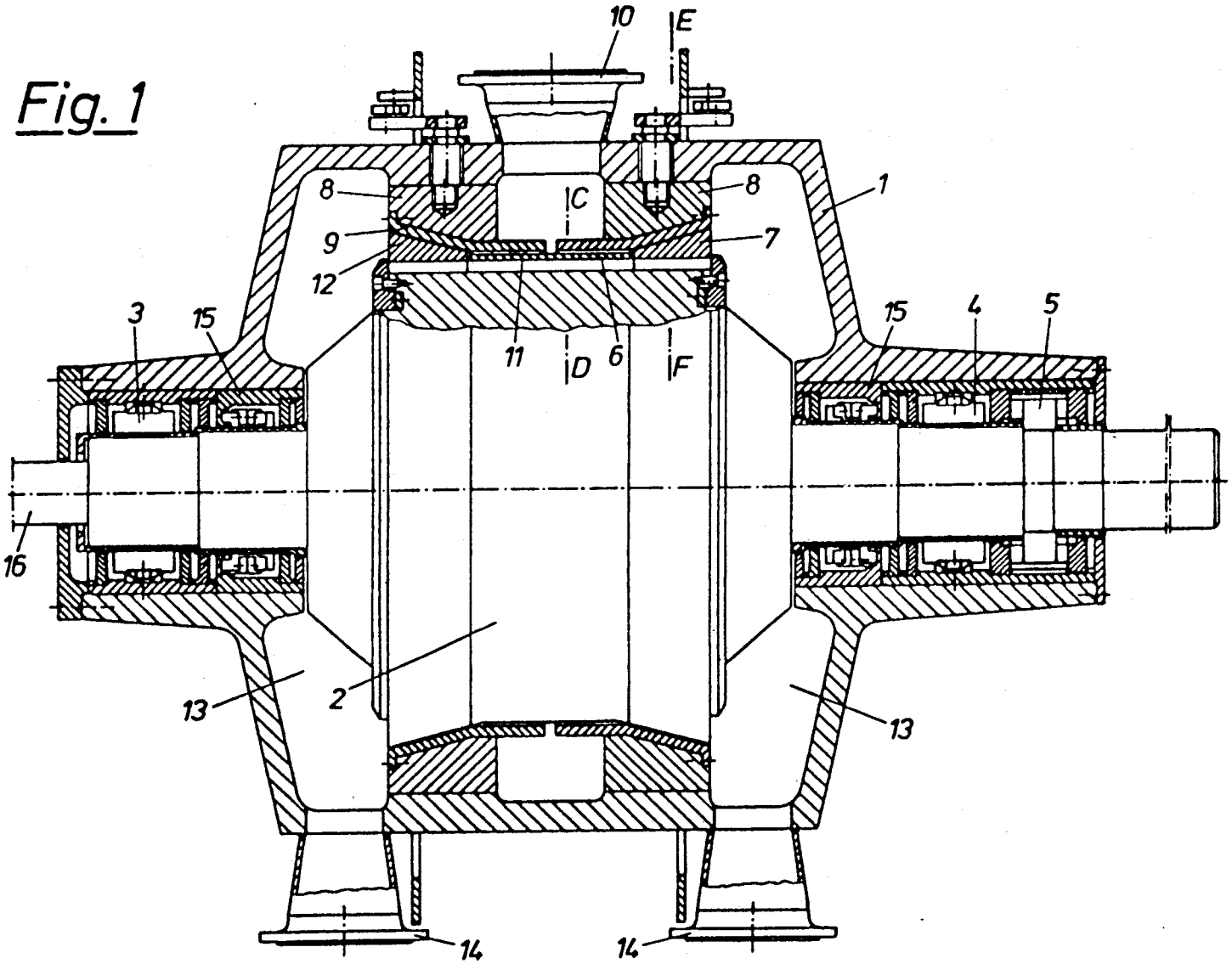
FIG. 1 shows an axial sectional view in the plane A-B according to FIG. 2.

FIGS. 1 to 5 show a preferably horizontally divided refiner housing 1 in which a cylindrical rotor 2 is supported on both sides by bearings 3, 4 and 5, which can be rolling or sliding bearings, but preferably sliding bearings with tilting segments, the type of bearing being used depending on diameter, capacity and number of revolutions per minute. This rotor 2 is provided with grinding plates 6 and 7, grinding plate 6 being disposed along a cylindrical jacket part of the housing for precrushing the chips and grinding plate 7 enclosing an angle with the axis of the rotor serving for defibration. Due to the form of the grinding plate 7, an inclination of the grinding zone to the horizontal between 5° and 45°, preferably 15°, is achieved.

Opposing grinding plates 9 and 9' cooperating with the grinding plate 7 are provided on two stator rings 8 horizontally displaceable for the adjustment of the grinding gap.

Figures 2, 3, 4:
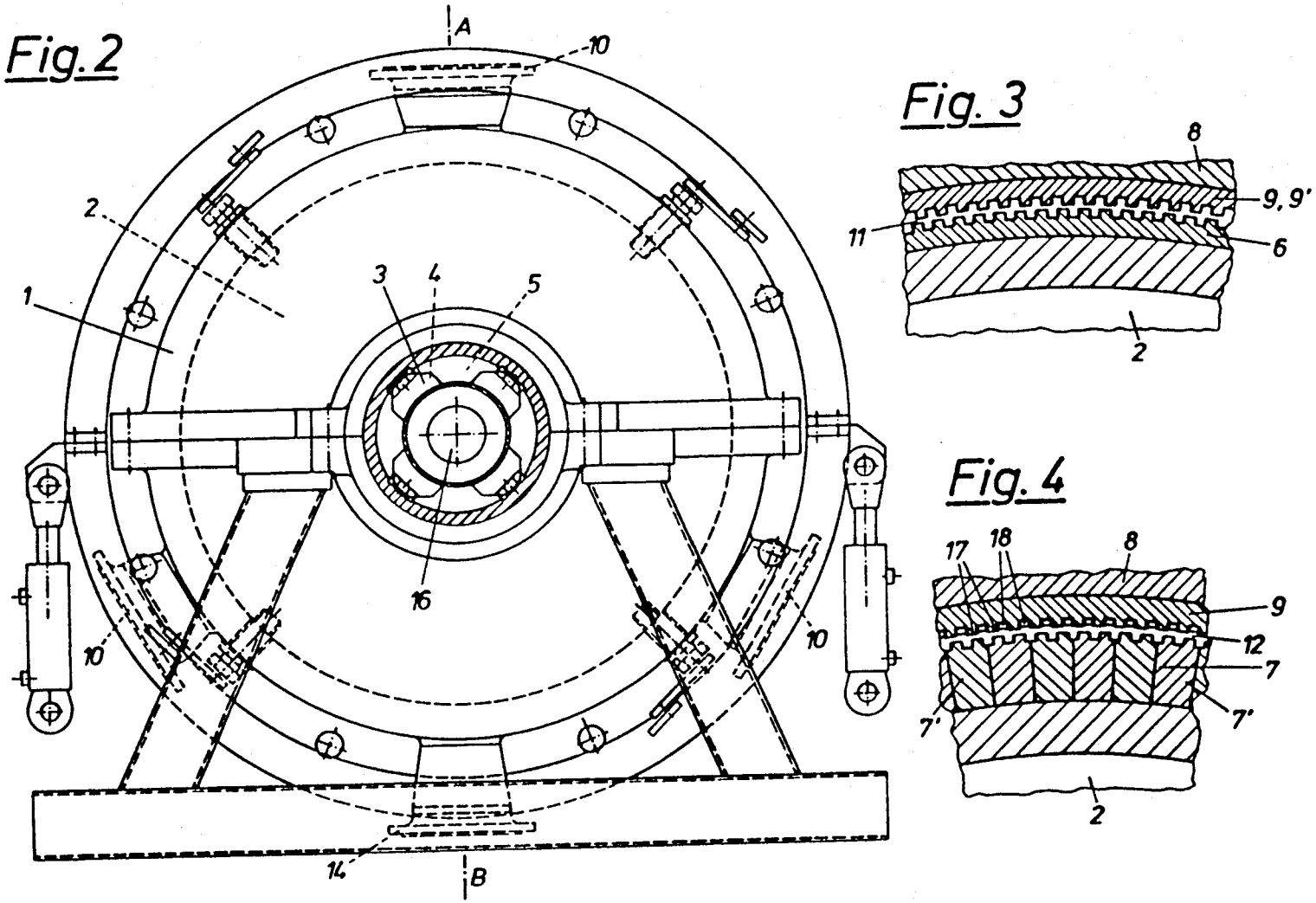
FIG. 2 shows a front view.
FIG. 3 shows a sectional view in the plane C-D of FIG. 1 at enlarged scale.
FIG. 4 shows a corresponding sectional view in the plane E-F again as an enlarged detail.
Figure 5:
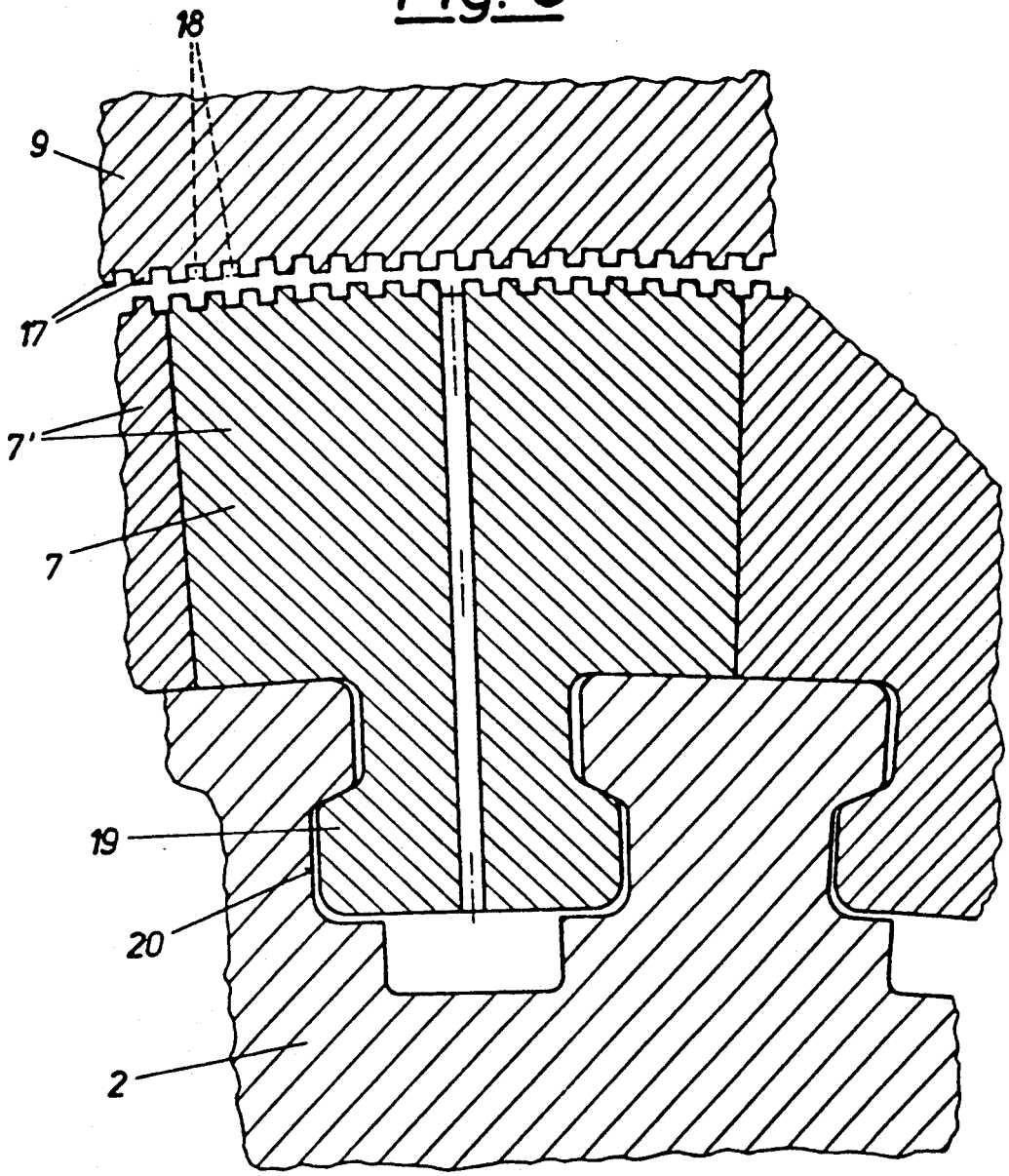
FIG. 5 shows a detail on even larger scale of a variant in a sectional view similar to FIG. 4.

FIGS. 3 and 4 show in slightly enlarged scale detail cross sections through the grinding plate area, FIG. 3 in the area parallel to the axis and FIG. 4 in the frustoconical area. According to FIG. 4, the opposing ribs 17 of the outer grinding plate 9 can be reinforced by means of cross webs or cross ribs 18. These webs or ribs 18 are provided in order to retain the fibrous material, thus to increase its dwell time in the grinding zone. The inner grinding plate 7 of the frustoconical area can be composed of segments 7' (FIG. 4). Such an embodiment of dimensions particularly well adapted to practice is shown in FIG. 5, although with only partly indicated cross webs 18. Anchoring lugs 19 in corresponding rotor grooves 20 of hammerhead-like cross section are provided.

The chips are fed in particular by means of a conveyor screw, in this example radially from one to four material feeds 10 with openings on the periphery. The chips are precrushed in a horizontal grinding gap 11 and distributed symmetrically in both directions. The defibration of the wood is effected in the adjustable grinding gap 12 inclined to the horizontal. The grinding stock is then conveyed to the inner space 13 of the refiner housing 1 and is discharged at 14 together with the generated steam.

The bearings are sealed against the steam in the refiner housing via sealing units 15.

On the free shaft end 16, an engine, preferably a direct current engine, of essentially lower output than the main engine, can be installed in order to reduce the starting current peak.

By means of this embodiment modified in comparison to the refiners of prior art, the refiner according to the invention can be operated with up to 3,600 rpm.

The invention is advantageously applicable to refiners with vertically extending rotor shafts. The comminution of fibrous materials other than wood is easily effected, water or other liquids being added to the precrushed material under certain conditions.

According to the invention, a considerable reduction of material stress in comparison to the known refiners is achieved, the stress on the bearings being decreased and the service life of the bearings being prolonged. As a result, an increase of material throughput can be obtained.

Figure 6:
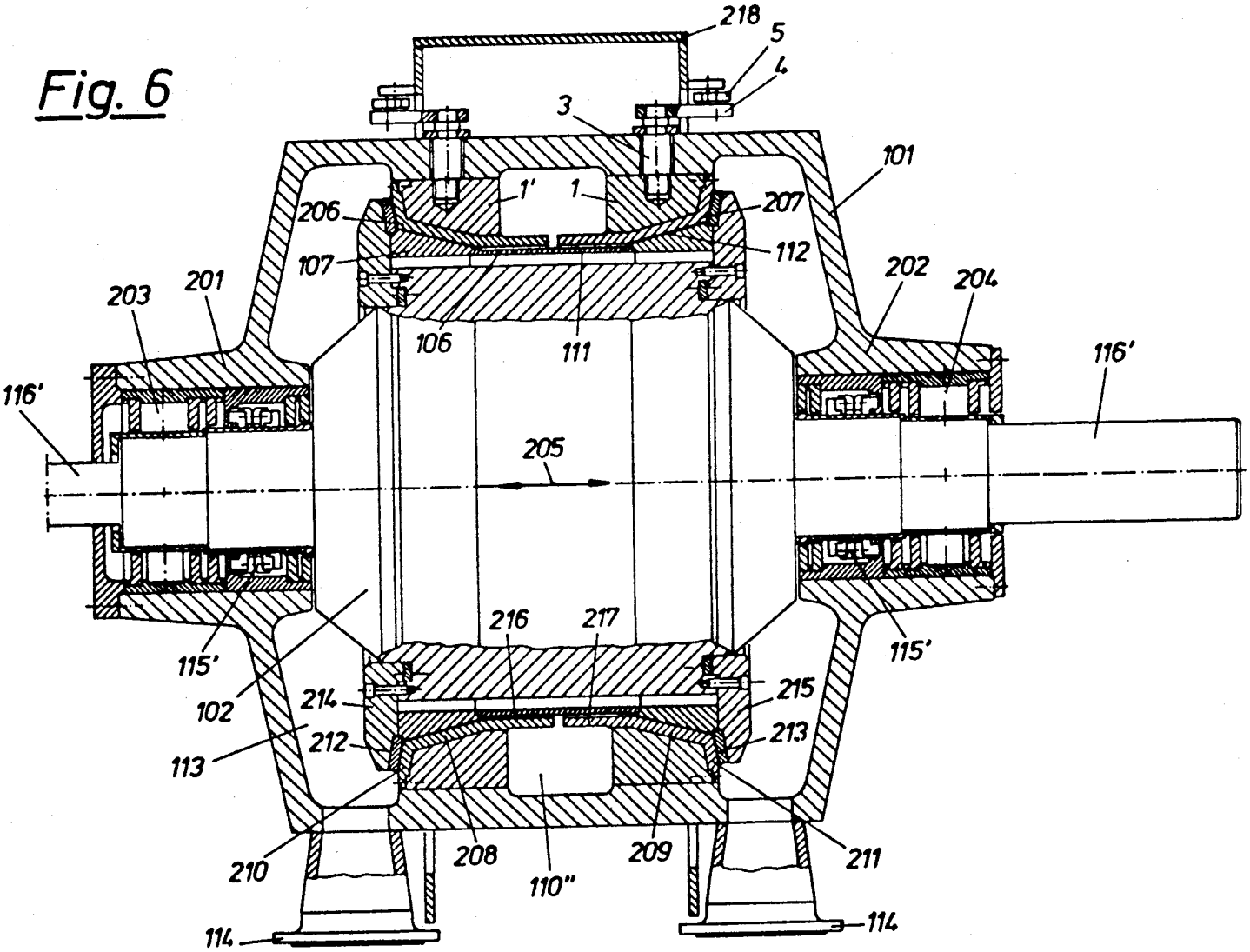
FIG. 6 to 8 represent a variant with modified grinding gap and floating rotor support in axial sectional view, front view and elevational view.
Figure 7:
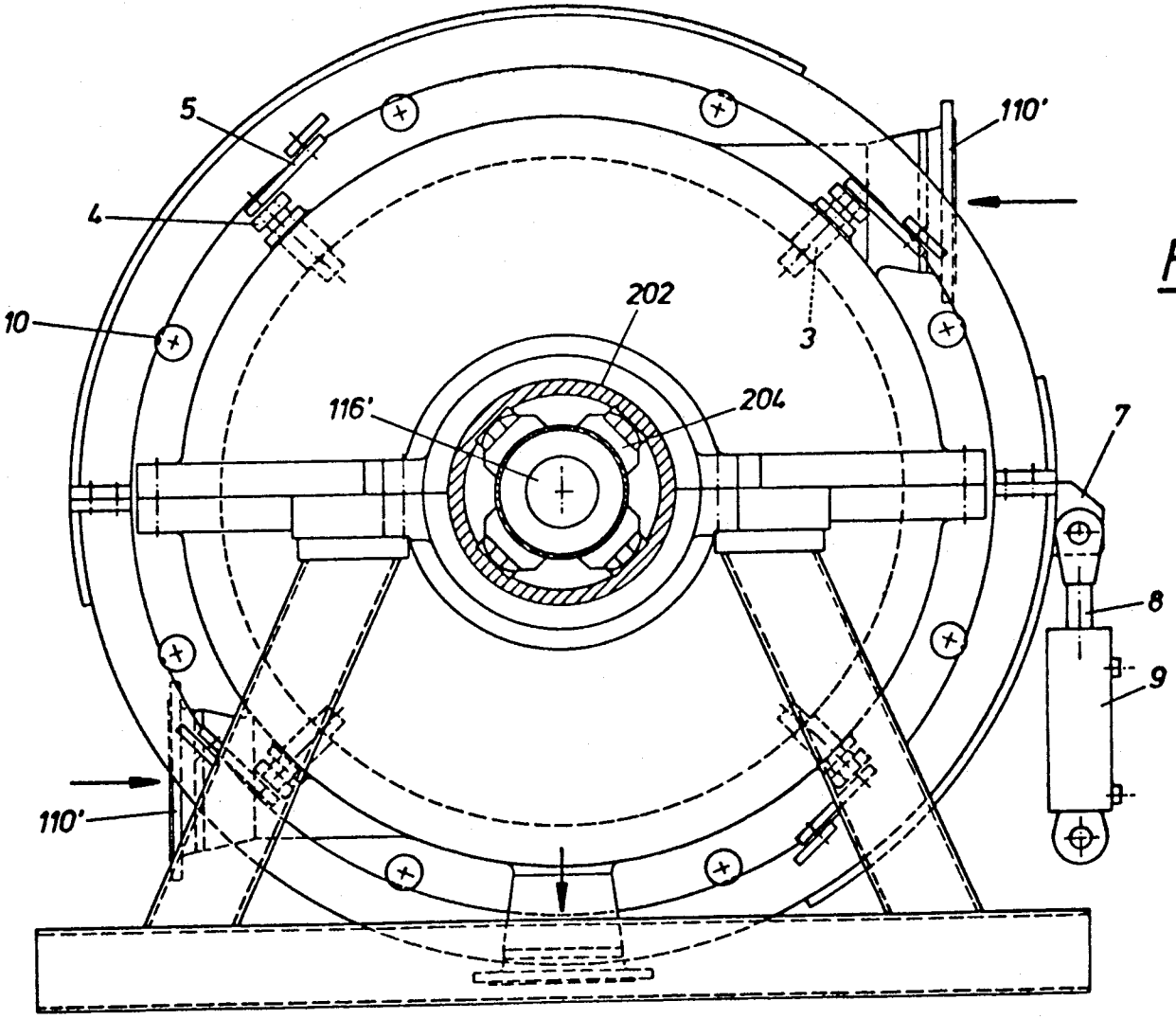
Figure 8:
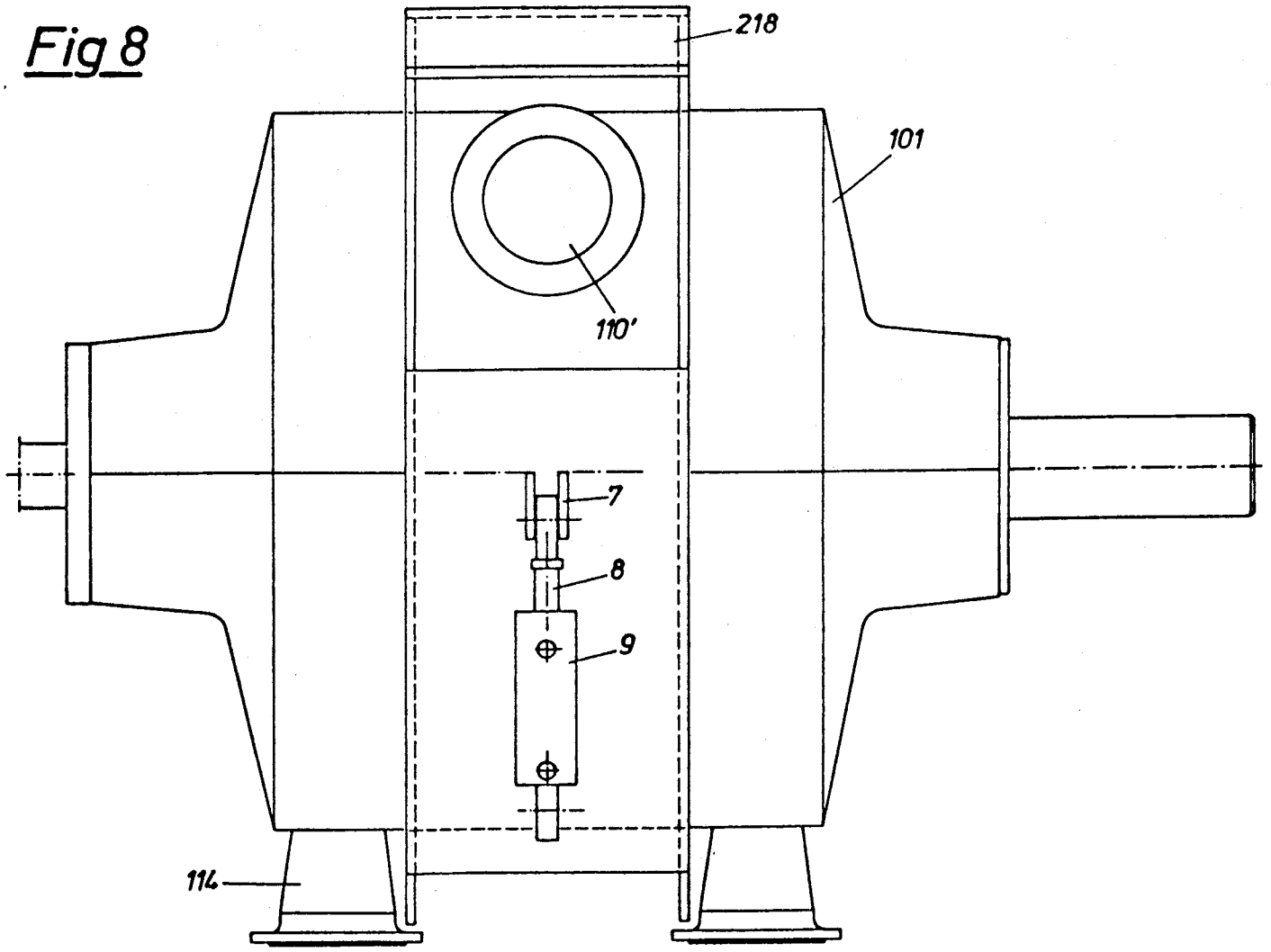

The embodiment according to FIGS. 6 to 8 differs from those previously shown above all by the type of material feed, the special support of the rotor and the modified stator adjustment. Corresponding parts are provided with the same reference numbers as those shown in FIGS. 1 to 5.

In this case, the material feed is effected at 110' in two locations approximately tangentially to the rotor 102 into the annular space 110'' from which the material is then conveyed to the grinding plates. The shaft ends 116' of the rotor 102 and thus the rotor 102 itself are floatingly supported in this case. For this purpose, hydrostatic sliding bearings 203 and 204 are provided in the bearings 201 and 202. The bearings are sealed against the steam in the refiner housing 101 via sealing units 115'. The double arrow 205 indicates the rotor movement or floating rotor support made possible by the previously described support of the rotor. Although the adjustability of only one stator may be sufficient in this case, the adjustment of both of the stator 1, 1' and thus of the grinding plates or the like 206, 207 attached to them is also provided for in this case; these grinding plates of the like are provided, in addition to the frustoconical parts 206, 207, with parts 210, 211 enclosing an angle of nearly 90° with the rotor axis. Cooperating with the parts 210, 211 are additional grinding plates 212, 213 extending equally steeply to the rotor axis as the parts 210, 211 and supported by special rings 214, 215 connected to the rotor 102.

The adjustment of the stators 1, 1' and thus of the grinding plates 206, 207, 210, 211, but also of the cylindrically shaped grinding plates, is effected in a manner similar to that represented in FIG. 1 to 5 via the parts 3 to 5, although in this case simultaneously and in opposing direction via curved hoops 218 which are uniformly displaced by the adjusting means 7 to 9. In view of the floatingly supported rotor, the adjustment of only one stator would be possible in this case as well. The second stator would then be rigidly supported in the housing. The mobility for the grinding gap adjustment is provided by the free axial displaceability (floating support) of the rotor.

We claim:

1. A drum refiner for grinding of wet fibrous material, having an engine-driven rotor with frustoconical surfaces provided with at least grinding elements, said grinding elements having diameters with dimensions which increase in the direction away from an at least one material feed, said rotor having a horizontal rotation shaft which is received by a housing, said housing having inner walls corresponding to said frustoconical surfaces of said rotor and having grinding surfaces arranged on said walls to correspond to and have the same increasing dimensions as said grinding elements, said housing receiving the rotor, said horizontal rotation shaft of said rotor being received by bearings located within said housing, said at least one material feed being directed approximately radially to the rotor axis and disposed approximately in the center of said housing, said grinding surfaces enclosing an angle with respect to the rotor axis on both sides of the cross medium plane of the drum refiner which is open to the front faces of the rotor, the improvement comprising (1) said rotor being received by said bearing located within said housing, (2) that grinding surfaces and elements extend approximately parallel to the rotor axis on a jacket of the drum shaped rotor and corresponding opposing grinding surfaces on the housing are provided with increasing diameters in a direction away from the at least one material feed, (3) that the grinding surfaces and grinding elements are arranged parallel to the axis and inclined to the axis of the rotor as well as being arranged symmetrically to the median plane of the at least one approximately radial material feed, and (4) that the grinding surfaces and grinding elements arranged parallel to the axis are followed immediately mergingly by the grinding surfaces and grinding elements which are inclined toward the axis of the rotor.

2. The drum refiner according to claim 1, wherein the grinding gaps are inclined toward the axis of the rotor and are adjustable for the purpose of providing variable grinding operations, said adjustable gaps being provided by at lest one stator ring that is approximately horizontally displaceable within said housing.

3. The drum refiner according to claim 1, wherein an annular material feed gap is provided by an annular space enclosing the outside of the rotor within the housing, said annular space being provided approximately in the cross-axial median plane of the drum refiner between the grinding surfaces and grinding elements that extend parallel to the axis, said annular feed gap accepting the material that empties from said at least one material feed.

4. The drum refiner according to claim 1, wherein said housing receiving said rotor is provided with two front walls on both sides of the rotor each of which wall lodging a shaft bearing for the rotor, said housing also having cavities into which the material reduced within the grinding gaps immediately empty, said cavities being provided in the area of the two front walls of the housing in the vicinity of the shaft bearings, said cavities being provided on both sides of the rotor, said walls of the housing having grinding surfaces arranged to be parallel to the axis of the rotor, said cavities being sealed steam-tight against the shaft bearings by means of special sealing units which are inserted in the bearing housing and placed between rotor and bearings on the side of the rotor, said cavities being provided with discharge openings for the comminuted material reduced by the operation of all of the crushing and grinding surfaces.

5. A drum refiner for grinding of fibrous material sometimes mixed with water, said drum refiner having an engine-driven drumshaped rotor with at least two rotation surfaces provided with grinding elements having diameters with dimensions which increase in a direction away from an at least one material feed, said rotor having a horizontal rotation shaft which is received by a housing, said housing having inner walls with grinding surfaces corresponding to said grinding elements of said rotor, said at least one material feed extending approximately tangentially to the rotor and being provided approximately in the center of said housing, said grinding surfaces enclosing an angle with respect to the rotor axis on both sides of the cross medium plane of the drum refiner which is open to the front faces of the rotor, said grinding surfaces and grinding elements all having central regions which are parallel to and adjacent with said at least one material feed, said grinding surfaces and grinding elements all having outer regions which are inclined to the axis of the rotor and which immediately merge with said central regions, the improvement comprising: (1) said rotor having a horizontal rotation shaft which is received by said housing, (2) that grinding surfaces extend approximately parallel to the rotor axis and also extend between the at least one material feed and the grinding elements and are of increasing diameters on a jacket of the drum-shaped rotor and corresponding opposing grinding surfaces are provided on the housing, (3) that the grinding surfaces and grinding elements are inclined to the axis of the rotor as well as all being arranged symmetrically to the medium plane of the at least one approximately tangential material feed, and (4) that the grinding surfaces and grinding elements which are parallel to the axis are immediately mergingly followed by the grinding surfaces and grinding elements which are inclined to the axis.

6. The drum refiner according to claim 5, wherein the grinding surfaces and grinding elements which are inclined toward the axis are adjustable for the purpose of providing variable grinding operations, said adjustable grinding surfaces and grinding elements being provided by at least one stator ring that is approximately horizontally displaceable within said housing.

7. The drum refiner according to claim 5, wherein an annular material feed gap is provided by an annular space enclosing the outside of the rotor within the housing, said annular space being approximately in the cross-axial median plane of the drum refiner between the grinding surfaces and grinding elements that extend parallel to the axis of the rotor, said annular material feed gap accepting the material from said approximately tangential material feed.

8. The drum refiner according to claim 5, wherein said housing receiving said rotor is provided with two front walls on both sides of the rotor each of which walls lodging a shaft bearing for the rotor, said housing also having cavities into which the material reduced within the grinding gaps immediately empties, said cavities being provided in the area of the two front walls of the housing in the vicinity of the shaft bearings, said cavities being provided on both sides of the rotor, said walls of the housing having grinding surfaces some of which are arranged to be parallel to the axis of the rotor, and some of which are arranged to be inclined to the axis of the rotor, said cavities being sealed steam-tight against the shaft bearings by means of special sealing units which are inserted in the housing and placed between rotor and bearings on the side of the rotor, said cavities being provided with discharge openings for the comminuted material reduced by the operation of all of the grinding surfaces and elements.

9. A drum refiner for the grinding of fibrous materials comprising:

an engine-driven drumshaped rotor having an approximately horizontally supported rotor axis and two front faces;

an engine-driven drumshaped rotor having an approximately horizontally supported rotor axis and two front faces;

at least one material feed;

a rotor shell with at least two rotation surfaces with grinding elements inclined to the rotor axis, said two rotation surfaces increasing in inclination in a direction away from said at least one material feed, wherein said rotation surfaces have an opposed inclination away from the rotor axis;

a housing receiving said rotor, said housing having inner walls opposing the two rotation surfaces of said rotor with opposing grinding surfaces provided thereon, said housing lodging at least two stator rings which are generally horizontally displaceable within the housing, said stator rings being displaceable independently of one another, said stator rings having grinding surfaces which are opposing said grinding elements of said rotor housing;

said grinding elements of said rotor shell being equipped with ribs of essentially axial extension;

grinding gaps being formed between said grinding elements on said rotor shell and said opposing grinding surfaces on said housing, said grinding surfaces having means to adjust the spacing between the grinding surfaces and the grinding elements so as to provide said grinding gaps, said gaps being inclined to the rotor axis;

said at least one material feed having a cross-axial median plane which extends approximately tangentially to the rotor shell and is approximately in the center of said housing, said grinding surfaces of said housing being arranged to provide an angle which increases in both directions away from said at least one material feed;

said grinding surfaces of said housing enclosing an angle with respect to the rotor axis on both sides of the cross median plane of the drum refiner which is open to the front faces of the rotor;

additional grinding elements being provided on the shell of the drumshaped rotor and correspondingly opposing grinding being provided on said housing, said grinding surfaces and grinding elements including said additional surfaces and elements all having central regions which are parallel to the rotor axis and adjacent to said material feed, said grinding surfaces and grinding elements including said additional surfaces and elements all having outer regions that form an angle which continuously increases in inclination in both directions away from said feed, said grinding and additional surfaces of said inner walls being spaced apart from corresponding said grinding and additional elements of said rotor so as to form said grinding gaps;

said grinding gaps having central and outer regions with the central region being parallel to the axis of said rotor and the outer regions increasing in angle in a direction away from said at least one material feed as said outer regions incline away from the axis;

said grinding surfaces and elements including said additional surfaces and elements being inclined away from the axis of said rotor and arranged symmetrical to the median plane of said at least one material feed and all such surfaces and elements having associated outer regions which are inclined away from the axis of the rotor and which immediately follow and merge with associated central regions which are parallel to the axis;

an annular material feed gap is provided by an annular space enclosing the outside of the rotor within the housing, said annular space being provided approximately in the cross-axial median plane of the drum refiner between the grinding surfaces of said at least one stator ring and the grinding elements of said rotor that extends parallel to the axis, said annular material feed gap accepting the material that empties from said at least one material feed;

said housing receiving said rotor being provided with two front walls on both sides of the rotor each of which walls lodging a shaft bearing for the rotor, said housing also having cavities into which the material reduced within said grinding gaps immediately empty, said cavities being provided in the area of the two housing front walls in the vicinity of the shaft bearings, said cavities being provided on both sides of the rotor, said cavities being sealed steam-tight against said shaft bearings by means of special sealing units inserted in the bearing housings and placed between the rotor and bearings on the side of the rotor, said cavities being provided with discharge openings for the ground material that is created by all of said grinding surfaces and elements.

10. A drum refiner for the grinding of fibrous material comprising:

an engine-driven drumshaped rotor having a horizontally supported rotor axis and two front faces;

at least one material feed directed radially to the rotor axis and having a cross-axial median plane;

a rotor shell with two rotation surfaces inclined to the rotor axis and which increase in inclination in a direction away from said at least one material feed, said two rotation surfaces of said rotor shell being provided with grinding elements;

a housing receiving said rotor, said housing having inner walls opposing the two rotation surfaces of said rotor shell with grinding surfaces arranged thereon;

grinding gaps being formed between said grinding elements of said rotor shell and said grinding surfaces of said housing, said grinding surfaces having means to adjust the spacing between the grinding surfaces and the grinding elements so as to provide said grinding gaps, said grinding gaps being inclined to the rotor axis, said opposing grinding surfaces of the housing being provided on two stator rings which are generally horizontally displaceable within one housing;

said grinding elements of said rotor shell being equipped with ribs of essentially axial extension;

said at least one material feed being arranged approximately in the center of said housing, said grinding elements extending on the shell of said rotor and said opposing surfaces of the inner walls of the housing being on both sides of said at least one material feed, sid surfaces of said inner walls being arranged to form an angle with the axis of the rotor which is open to the front faces of the rotor, additional grinding elements being provided on the shell of the drumshaped rotor, said grinding elements being situated between said at least one material feed and said inner walls, said parallel grinding surfaces and grinding elements including said additional elements all having outer regions that form an angle with the axis of said rotor and the grinding surfaces and grinding elements including said additional elements all having inner regions which are parallel to and adjacent with said at least one material feed, said outer regions of all of said grinding surfaces and grinding elements including said additional elements forming an angle which continuously increases in inclination in both directions away from said at least one material feed, said grinding and additional surfaces of said inner walls being spaced apart from corresponding said grinding and additional elements of said rotor so as to form said grinding gaps;

said grinding gaps having central and outer regions with the central regions being parallel to the axis and the outer regions increasing in angle in a direction away from said at least one material feed as said outer regions continuously incline away from the axis of said rotor, wherein said grinding surfaces and elements including said additional elements are arranged symmetrically to the median plane of said at least one material feed and have associated outer regions which incline away from the axis and which immediately follow and merge with associated central regions which are parallel to the axis;

an annular material feed gap is provided by an annular space enclosing the outside of the rotor within the housing, said annular space being provided approximately in the cross-median plane of the drum refiner between the grinding surfaces of said stator rings and the grinding elements of said rotor that extend parallel to the axis of the rotor, said annular feed gap accepting the material that empties from said at least one material feed;

said housing receiving said rotor being provided with two front walls on both sides of the rotor each of which walls lodging a shaft bearing for the rotor, said housing also having cavities into which the material reduced within the grinding gaps immediately empty, said cavities being provided in the area of the two housing front walls in the vicinity of the shaft bearings, said cavities being provided on both sides of the rotor, said cavities being sealed steam-tight against said shaft bearings by means of special sealing units inserted in the bearing housings and placed between the rotor and bearing on the side of the rotor, said cavities being provided with discharge openings for the ground material that is created by the operation of all of said grinding surfaces and elements.

11. The drum refiner according to claim 10, wherein the outer regions associated with all of said grinding surfaces and grinding elements including said additional surfaces and elements enclose an angle of approximately 5 to 45 degrees with the rotor axis.

12. The drum refiner according to claim 10, wherein the additional grinding surfaces on said inner walls include grinding surfaces located at the outer regions that are inclined by an angle which is increased relative to the angle of the remainder of said grinding surfaces and similarly, the additional grinding elements on said rotor include grinding elements located at the outer regions that are inclined by an angle which is increased relative to the angle of the remainder of said grinding elements.

13. The drum refiner according to claim 12, wherein the increased angle of said additional grinding surfaces and grinding elements at said outer regions is approximately 90 degrees inclined to said rotor axis.

14. The apparatus according to claim 10, wherein at least two displaceable stator rings are provided both of which cooperate with each other to provide said adjustable gaps.

15. The drum refiner according to claim 14, wherein the two stator rings are displaceable independently of one another.

16. The drum refiner according to claim 10, wherein the rotor is displaceably supported by bearings on both sides of said rotor.

17. The drum refiner according to claim 16 wherein the rotor is axially displaceably and floatingly supported in hydrostatic sliding bearings and each of which has a sealing unit enclosing the rotor shaft in a bearing located in a wall of said housing and which unit is positioned between said sliding bearing and the interior of the housing receiving the rotor.

18. The drum refiner according to claim 10, wherein the grinding elements provided on said drumshaped rotor have diameters with dimensions which increase in a direction away from the at least one material feed, said rotor being supported in sliding bearings by means of a rotation shaft fixedly connected to the rotor, said rotor being provided with a special starting engine for the starting operation and wherein the main engine of the drum refiner is designed to operate at about 3000 to 3600 rpm at full load.

19. A drum refiner for the grinding of wet fibrous material comprising:

an engine-driven drumshaped rotor having an approximately horizontally supported rotor axis and two front faces;

at least one material feed directed approximately radially to the rotor axis and having a cross-axial median plane;

a rotor shell with two frustoconical rotation surfaces which continuously increase in inclination in a direction away from said at least one material feed, said two rotation surfaces of said rotor shell each having an opposed inclination away from the rotor axis, and said rotation surfaces being provided with grinding elements;

a housing receiving the rotor, said housing having inner walls opposing the two rotation surfaces of said rotor which opposing grinding surfaces arranged thereon, said housing lodging at least one stator ring which is horizontally displaceable within the housing, said stator ring having grinding surfaces which are opposed said grinding elements of said rotor;

grinding gaps being formed between said grinding elements of said rotor shell and said grinding surfaces of said housing, said grinding surfaces having means to adjust the spacing between the grinding surfaces and the grinding elements so as to provide said grinding gaps, said gaps being inclined to the rotor axis;

said grinding elements of said rotor shell being equipped with ribs of essentially axial extension;

said at least one material feed being disposed approximately in the center of said housing, said grinding elements on said rotor and said opposing grinding surfaces on said housing are both arranged to form an angle which increases in inclination in both directions away from said at least one material feed, said opposing grinding surfaces of said housing enclosing an angle with respect to the rotor axis on both sides of the cross-median plane of the drum refiner which is open to the front faces of said rotor;

additional grinding elements in said rotor and said opposing grinding surfaces in said housing being provided which are adjacent to said at least one material feed, said grinding surfaces and said grinding elements including said additional surfaces and elements having outer regions which form an angle which continuously increases in inclination in both directions away from said at least one material feed, said grinding and additional surfaces of said inner walls being spaced apart from corresponding said grinding and additional elements of said rotor so as to form said grinding gaps;

said grinding gaps having central and outer regions with the central regions being parallel to the axis of the rotor and outer regions increasing in angle in a direction away from said at least one material feed as said outer regions continuously incline away from the axis of the rotor and wherein all of said grinding surfaces and elements including said additional surfaces and elements are arranged symmetrical to the median plane of said at least one material feed and have associated outer regions which incline away from the axis and which immediately follow and merge with associated inner regions which are parallel to the axis of the rotor;

an annular material feed gap is provided by an annular space enclosing the outside of the rotor within the housing, said annular space being provided approximately in the cross-axial median plane of the drum refiner between the grinding surfaces of said at least one stator ring and the grinding elements of said rotor that extend parallel to the axis, said annular feed gap accepting the material that empties from said at least one material feed;

said housing receiving said rotor being provided with two front walls on both sides of the rotor each of which walls lodging a shaft bearing for the rotor, said housing also having cavities into which the material reduced within said grinding gaps immediately empty, said cavities being provided in the area of the two housing front walls in the vicinity of the shaft bearings, said cavities being provided on both sides of the rotor, said cavities being sealed steam-tight against said shaft bearings by means of special sealing units inserted in the bearing housings and placed between the rotor and bearings on the side of the rotor, said cavities being provided with discharge openings for the ground material that is created by all of said grinding surfaces and elements.

20. The drum refiner according to claim 19, wherein the grinding surfaces and gaps enclose an angle of approximately 5 to 45 degrees with the rotor axis.

21. The drum refiner according to claim 19, wherein the additional grinding surfaces on said inner walls include grinding surfaces located at the outer regions that are inclined by an angle which is increased relative to the angle of the remainder of said grinding surfaces and similarly, the additional grinding elements on said rotor include grinding elements located at the outer regions that are inclined by an angle which is increased relative to the angle of the remainder of said grinding elements.

22. The drum refiner according to claim 21, wherein the increased angle of said additional grinding surfaces and grinding elements at said outer regions is approximately 90 degrees inclined to said rotor axis.

23. The drum refiner according to claim 19, wherein at least two displaceable stator rings are provided.

24. The drum refiner according to claim 23, wherein the stator rings are displaceable independently of one another.

25. The drum refiner according to claim 19, wherein the rotor is supported displaceably on both sides in its bearings.

26. The drum refiner according to claim 25, wherein the rotor is axially displaceably and floatingly supported in a hydrostatic sliding bearing and has a sealing unit enclosing the rotor shaft in a bearing located in a wall of said housing and which unit is positioned between said sliding bearing and the interior of the housing receiving the rotor.

27. The drum refiner according to claim 19, wherein the drumshaped rotor is provided on its shell with grinding elements which are approximately parallel to its axis, said grinding elements having diameters with dimensions which increase in a direction away from the material feed, said grinding elements with increasing diameter being adjacent on both sides of said at least one material feed, said rotor being supported in sliding bearings by means of a rotation shaft fixedly connected to the rotor, said rotor being provided with a special starting engine for starting operation and the main engine of said drum refiner being provided for an operation of said drum refiner at approximately 3000 to 3600 rpm at full load.

28. A drum refiner for the grinding of fibrous materials comprising:

an engine-driven drumshaped rotor having an approximately horizontally supported rotor axis and two front faces;

at least one material feed;

a rotor shell with at least two rotation surfaces with grinding elements inclined to the rotor axis, said two rotation surfaces increasing in inclination in a direction away from said at lest one material feed, wherein said rotation surfaces have an opposed inclination away from the rotor axis;

a housing receiving said rotor, said housing having inner walls opposing the two rotation surface of said rotor with opposing grinding surfaces provided thereon, said housing lodging at least one stator ring which is generally horizontally displaceable within the housing, said stator ring having grinding surfaces which are opposing said grinding elements of said rotor;

said grinding elements of said rotor shell being equipped with ribs of essentially axial extension;

grinding gaps being formed between said grinding elements on said rotor shell and said opposing grinding surfaces on said housing, said grinding surfaces having means to adjust the spacing between the grinding surfaces and the grinding elements so as to provide said grinding gaps, said gaps being inclined to the rotor axis;

said at least one material feed having a cross-axial median plane which extends approximately tangentially to the rotor shell and is approximately in the center of said housing, said grinding surfaces of said housing being arranged to provide an angle which increases in both directions away from said at least one material feed;

said grinding surfaces of said housing enclosing an angle with respect to the rotor axis on both sides of the cross median plane of the drum refiner which is open to the front faces of the rotor;

additional grinding elements being provided on the shell of the drumshaped rotor and correspondingly opposing grinding elements being provided on said housing, said grinding surfaces and grinding elements including said additional surfaces and elements all having central regions which are parallel to the rotor axis and adjacent to said material feed, said grinding surfaces and grinding elements including said additional surfaces and elements all having outer regions that form an angle which continuously increase in inclination in both directions away from said feed, said grinding and additional surfaces of said inner walls being spaced apart from corresponding said grinding and additional elements of said rotor so as to form said gaps;

said grinding gaps having central and outer regions with the central regions being parallel to the axis of said rotor and the outer regions increasing in angle in a direction away from said at least one material feed as said outer regions incline away from the axis;

said grinding surfaces and elements including said additional surfaces and elements being inclined away from the axis of said rotor and arranged to be symmetrical to the median plane of said at least one material feed and all such surfaces and elements having associated outer regions which are inclined away from the axis of the rotor and which immediately follow and merge with associated central regions which are parallel to the axis;

an annular material feed gap is provided by an annular space enclosing the outside of the rotor within the housing, said annular space being provided approximately in the cross-axial median plane of the drum refiner between the grinding surfaces of said at least one stator ring and the grinding elements of said rotor that extend parallel to the axis, said annular material feed gap accepting the material that empties from said at least one material feed;

said housing receiving said rotor being provided with two front walls on both sides of the rotor each of which wall lodging a shaft bearing for the rotor, said housing also having cavities into which the material reduced within said grinding gaps immediately empty, said cavities being provided in the area of the two housing front walls in the vicinity of the shaft bearings, said cavities being provided on both sides of the rotor, said cavities being sealed steam-tight against said shaft bearings by means of special sealing units inserted in the bearing housings and placed between the rotor and bearings on the side of the rotor, said cavities being provided with discharge openings for the ground material that is created by all of said grinding surfaces and elements.

29. The drum refiner according to claim 28, wherein the grinding surfaces and gaps enclose an angle of about 5 to 45 degrees with the rotor axis.

30. The drum refiner according to claim 28, wherein the additional grinding surfaces on said inner walls include grinding surfaces located at the outer regions that are inclined by an angle which is increased relative to the angle of the remainder of said grinding surfaces and, similarly, the additional grinding elements on said rotor include grinding elements located at the outer regions that are inclined by an angle which is increased relative to the angle of the remainder of said grinding elements.

31. The drum refiner according to claim 30, wherein said increased angle of said additional grinding surfaces and grinding elements at said outer regions is approximately 90 degrees inclined to said rotor axis.

32. The drum refiner according to claim 28, wherein at least two displaceable stator rings are provided.

33. The drum refiner according to claim 28, wherein only one said at least one stator ring is provided and said rotor is supported displaceably in its bearings on both sides.

34. The drum refiner according to claim 33, wherein the rotor is axially displaceably and floatingly supported in a hydrostatic sliding bearing and has a sealing unit enclosing the rotor shaft in a bearing located in a wall of said housing and which is positioned between said sliding bearing and the interior of the housing receiving the rotor.

35. The drum refiner according to claim 28, wherein the drumshaped rotor has a shell provided with grinding elements which are approximately parallel to the axis of the rotor and adjacent to, on both sides, said at least one material feed, said grinding elements having diameters having dimensions which increase in a direction away from the material feed, said rotor being supported in sliding bearings by means of a rotation shaft that is fixedly connected to said rotor, said rotor being provided with a special starting engine for the starting operation of said drum refiner, said drum refiner having a main engine which is provided for an operation of 3000 to 3600 rpm at full load of said drum refiner.

36. A drum refiner for the grinding of fibrous material comprising:

a drumshaped rotor, driven by an engine at a rotational speed of 3000 to 3600 rpm and having a horizontally supported rotor axis and two front faces;

at least one material feed directed radially to the rotor axis and having a cross-axial median plane;

a rotor shell with two rotation surfaces inclined to the rotor axis and which increase in inclination in a direction away from said at least one material feed, said two rotation surfaces of said rotor shell being provided with grinding elements;

a housing receiving said rotor, said housing having inner walls opposing the two rotation surfaces of said rotor with grinding surfaces arranged thereon;

said grinding elements of said rotor shell being equipped with ribs of essentially axial extension;

grinding gaps being formed between said grinding elements of said rotor shell and said grinding surfaces of said housing, said grinding surfaces having means to adjust the spacing between the grinding surfaces and the grinding elements so as to provide said grinding gaps, said opposing grinding surfaces of the housing being provided on two stator rings which are generally horizontally displaceable within the housing, said grinding gaps being inclined to the rotor axis;

said at least one material feed being arranged approximately in the center of said housing, said grinding elements extending on the shell of said rotor and said opposing surfaces on the inner walls of the housing being on both sides of said at least one material feed, said surfaces of said inner walls being arranged to form an angle with the axis of the rotor which is open to the front faces of the rotor, additional grinding elements being provided on said shell as well as additional grinding surfaces being provided on said inner walls all of which extend approximately parallel to the rotor axis, said parallel grinding surfaces being situated between said at least one material feed and said grinding surfaces of said inner walls, said grinding surfaces and grinding elements including said additional surfaces all having outer regions which form an angle with the axis of said rotor and the grinding surfaces and grinding elements including said additional surfaces all having inner regions which are parallel to and adjacent with said at least one material feed, said outer regions forming an angle which continuously increases in inclination in both directions away from said at least one material feed, said grinding and additional surfaces of said inner walls being spaced apart from corresponding said grinding and additional elements of said rotor so as to form said grinding gap;

said grinding gaps having central and outer regions with the central region being parallel to the axis of the rotor and the outer regions increasing in angle in a direction away from said at least one material feed as said outer regions continuously incline away from the axis of the rotor, wherein all of said grinding surfaces and elements including said additional surfaces and elements are arranged symmetrically to the median plane of said at least one material feed and have associated outer regions which incline away from the axis and which immediately follow and merge with additional central regions which are parallel to the axis;

said housing receiving said rotor being provided with two front walls on both sides of the rotor each of which wall lodging a shaft bearing for the rotor, said housing also having cavities into which the material reduced within said grinding gaps immediately empties, said cavities being provided in the area of the two housing front walls in the vicinity of the shaft bearings, said cavities being provided on both sides of the rotor, said cavities being sealed steam-tight against said two bearings by means of special sealing units inserted in the bearing housings and placed between the rotor and bearings on the side of the rotor, said cavities being provided with discharge openings for the ground material that is created by all of said grinding and crushing surfaces and elements.

37. The drum refiner according to claim 36, wherein said two stator rings are displaceable independently of one another.

38. A drum refiner for the grinding of wet fibrous material, comprising:

a drumshaped rotor, driven by an engine at a high number of revolutions and having a horizontally supported rotor axis and two front faces;

at least one material feed directed approximately radially to the rotor axis and having a cross-axial median plane;

a rotor shell with two frustoconical rotation surfaces which continuously increase in inclination in a direction away from said at least one material feed, said two rotation surfaces having an opposed inclination away from the rotor axis, and said rotation surfaces being provided with grinding elements;

a housing receiving the rotor, said housing having inner walls opposing the two rotation surfaces of said rotor with opposing grinding surfaces arranged thereon;

said grinding elements of said rotor shell being equipped with ribs of essentially axial extension;

grinding gaps being formed between said grinding elements of said rotor shell and said grinding surfaces of said housing, said grinding surface having means to adjust the spacing between the grinding surfaces and the grinding elements so as to provide said grinding gaps, said grinding gaps being inclined to the rotor axis;

said at least one material feed being disposed approximately in the center of said housing, said grinding elements on said rotor and said opposing grinding surfaces on said inner walls being arranged to form an angle which increases in inclination in both directions away from said at least one material feed, said opposing grinding surfaces of said inner wall enclosing an angle with respect to the rotor axis on both sides of the cross median plane of the drum refiner which is open to the front faces of said rotor;

additional grinding elements in said rotor and said opposing grinding surfaces in said housing being provided which are approximately parallel to the rotor axis and adjacent to said at least one material feed, said grinding surfaces and said grinding elements including said additional surfaces and elements all having outer regions which form an angle which continuously increases in inclination in both directions away from said at least one material feed, said grinding and additional surfaces of said inner walls being spaced apart from corresponding said grinding and additional elements of said rotor so as to form said grinding gaps;

said grinding gaps having central and outer regions with the central regions being parallel to the axis of the rotor and said outer regions increasing in an angle in a direction away from said at least one material feed as said outer regions incline away from the axis of the rotor and wherein all of said grinding surfaces and elements including said additional surfaces and elements are arranged symmetrically to the median plane of said at least one material feed and have associated outer region which incline away from the axis and which immediately follow and merge with associated central regions which are parallel to the axis of the rotor;

said housing receiving said rotor being provided with two front walls on both sides of the rotor each of which wall lodging a shaft bearing for the rotor, said housing also having cavities into which the material reduced with said grinding gaps immediately empty, said cavities being provided in the area of the two housing front walls in the vicinity of the shaft bearings, said cavities being provided on both sides of the rotor, said cavities being sealed steam-tight against said shaft bearings by means of special sealing units inserted in the bearing housings and placed between the rotor and bearings on the side of the rotor, said cavities being provided with discharge openings for the ground material that is created by all of said grinding surfaces and elements.

39. The drum refiner according to claim 38, wherein the grinding gaps inclined away from the axis of the rotor are adjustable for the purpose of providing variable operations, said adjustable gaps are provided by at least one stator ring which is generally horizontally displaceable within said housing.

40. The drum refiner according to claim 39, wherein at least two displaceable stator rings are provided.

41. The drum refiner according to claim 39, wherein two stator rings are displaceable independently of one another.

42. A drum refiner for the grinding of fibrous material comprising:

a drumshaped rotor, driven by an engine at a high number of revolutions and having a horizontally supported rotor axis and two front faces;

at least one material feed;

a rotor shell with at least two rotation surfaces with grinding elements inclined to the rotor axis, said surfaces increasing in inclination in a direction away from said at least one material feed, wherein said rotation surfaces have an opposed inclination away from the rotor axis;

a housing receiving said rotor, said housing having inner walls opposing the two rotation surfaces of said rotor with opposing grinding surfaces provided thereon;

said grinding elements of said rotor shell being equipped with ribs of essentially axial extension;

grinding gaps being formed between said grinding elements of said rotor shell and said grinding surfaces of said housing, said grinding surfaces having means to adjust the spacing between the grinding surfaces and the grinding elements so as to provide said grinding gaps, said gaps being inclined to the rotor axis;

said at least one material feed having a cross-axial median plane which extends approximately tangentially to the rotor shell and is approximately in the center of said housing, said grinding surfaces of said housing being arranged to provide an angle which increases in both directions away from said at least one material feed, said grinding surfaces of said housing enclosing an angle with respect to the rotor axis on both sides of the cross median plane of the drum refiner which is open to the front faces of the rotor, additional grinding elements being provided on said rotor shell which are approximately parallel to the rotor axis, and correspondingly opposing grinding surfaces being provided on said housing, said grinding surfaces and grinding elements including said additional surfaces and elements all having central regions which are parallel to the rotor axis and adjacent to said at least one material feed, said grinding surfaces and grinding elements including said additional surfaces and elements all having outer regions that form an angle which continuously increases in inclination in both directions away from said feed, said grinding and additional surfaces of said inner walls being spaced apart from corresponding said grinding and additional elements of said rotor so as to form said grinding gaps;

said grinding gaps having a central and outer regions with the central region being parallel to the axis of the rotor and the outer regions increasing in angle in a direction away from said at least one material feed as said outer regions incline away from said axis;

said grinding surfaces and elements including said additional surfaces and elements being inclined away from the axis of the rotor and being arranged symmetrically to the median plane of said at least one material feed and all having associated outer regions which are inclined away from the axis of the rotor and which immediately follow and merge with associated central regions which are parallel to the axis;

said housing receiving said rotor being provided with two front walls on both sides of the rotor each of which wall lodging a shaft bearing for the rotor, said housing also having cavities into which the material reduced within said grinding gaps immediately empty, said cavities being provided in the area of the two housing front walls in the vicinity of the shaft bearings, said cavities being provided on both sides of the rotor, said cavities being sealed steam-tight against said two bearings by means of special sealing units inserted in the bearing housings and placed between the rotor and bearings on the side of the rotor, said cavities being provided with discharge openings for the ground material that is created by all of said grinding surfaces and elements.

43. The drum refiner according to claim 42, wherein the grinding gaps are inclined away from the axis of the rotor and are adjustable for the purpose of providing variable grinding operations, said adjustable gaps being provided by at least one stator ring which is generally horizontally displaceable within said housing.

44. The drum refiner according to claim 43, wherein at least two stator rings are provided.

45. The drum refiner according to claim 43, wherein two stator rings are displaceable independently of one another.

46. A drum refiner for the grinding of wet fibrous material comprising:

a drumshaped rotor, driven by an engine at a high rotational speed of up to 3600 rpm and having a horizontally supported rotor axis, two rotation surfaces and two front faces;

a housing receiving said rotor, said horizontal shaft of said rotor being received and supported by bearings located within said housing, said housing having two inner walls opposing each of the rotation surfaces of said rotor, said opposing surfaces being provided by a stator ring arranged on each of said inner walls;

at least one material feed arranged approximately in the center of said housing and directed approximately radially to the rotor axis and having a cross-axial median plane;

said rotation surfaces of said rotor being located on both sides of said at least one material feed and symmetrically disposed to the median plane of the at least one material feed, said rotation surfaces being equipped with precrushing elements with crushing surfaces that extend parallel to the axis of the rotor and which are adjacent to the at least one material feed, said precrushing elements being provided for precrushing the wet fibrous material and distributing it symmetrically in both directions away from said at least one material feed, said rotating surfaces further having grinding elements with grinding surfaces inclined to the axis of t he rotor and with diameters having dimensions which increase in a direction away from the at least one material feed, said inclined grinding surfaces of said rotor being provided for further refining the material that was precrushed by the precrushing elements and allowing such precrushed and refined material to be discharged as refined pulp along with generated steam;

said stator rings of the inner walls of the housing being located one on each side of and symmetrically to the at least one material feed, said stator rings being equipped with precrushing surfaces with crushing surfaces that extend parallel to the axis of the rotor and arranged so as to be opposite to corresponding precrushing elements on the rotor, said precrushing surfaces of said stator rings being inclined to the axis of the rotor;

grinding gaps being formed between said precrushing elements on the rotor and said precrushing surfaces on the stator rings, said precrushing surfaces of said stator rings having means to adjust the spacing between the precrushing elements and precrushing surfaces so as to provide said precrushing gaps, said precrushing gaps having central and outer regions with the central regions being parallel to the axis of the rotor and the outer regions immediately followed by and merging with said central regions; said outer regions being inclined to the axis;

said stator rings of the inner walls of the housing being horizontally displaceable independently of each other, said stator rings providing said means for adjusting the precrushing grinding gaps;

said precrushing elements of said rotor being equipped with ribs of essentially axial extension;

said housing receiving said rotor being provided with two front walls on both sides of the rotor each of which wall lodging a shaft bearing for the rotor, said housing also having cavities into which the material reduced within said grinding gaps immediately empty, said cavities being provided in the area of the two housing front walls in the vicinity of the shaft bearings, said cavities being provided on both sides of the rotor, said cavities being sealed steam-tight against said shaft bearings by means of special sealing units inserted in the bearing housings and placed between rotor and bearings on the side of the rotor, said cavities being provided with discharge openings for the ground material that is created by all of said precrushing and grinding surfaces and elements.

47. The drum refiner according to claim 46, wherein there is an annular material feed gap provided by an annular space enclosing the outside of the rotor within the housing, said annular space being provided approximately in said cross-axial median plane between the precrushing surfaces of said stator rings and the precrushing elements of the rotor all of which extend parallel to the axis, said annular material feed gap accepting the material that empties from said at least one material feed.

48. The drum refiner according to claim 47, wherein said at least one material feed comprises a plurality of feeds which are individually arranged at approximately equal distances measured along the periphery of said housing.

49. The drum refiner according to claim 46, wherein said precrushing surfaces of said stator rings are equipped with ribs.

50. A drum refiner for the grinding of wet fibrous material comprising:

a drumshaped rotor driven by an engine at a high rotational speed of up to 3600 rpm and having a horizontally supported rotor axis, two rotation surfaces and two front faces;

a housing receiving said rotor, said housing having at least one bearing for supporting said rotor, said housing having two inner walls opposing each of the rotation surfaces of said rotor, said opposing surfaces of each said two inner walls being provided by a stator ring arranged on each of said inner walls;

at least one material feed arranged approximately in the center of said housing and directed approximately tangentially to the rotor axis and having a cross-axial median plane;

said rotation surfaces of said rotor being located on both sides of said at least one material feed and arranged symmetrically to the median plane of the feed, said rotation surfaces being equipped with precrushing elements with crushing surfaces that extend parallel to the axis of the rotor and which are adjacent to the at least one material feed, said precrushing elements being provided for precrushing the wet fibrous material and distributing it symmetrically in both directions away from said at least one material feed, said rotation surfaces further having grinding elements with grinding surfaces inclined to the axis of the rotor and with diameters having dimensions which increase in a direction away from the at least one material feed, said inclined grinding surfaces being provided for further refining the material that was precrushed by the precrushing elements and allowing such precrushed and refined material to be discharged as refined pulp along with generated steam;

said stator rings of inner walls the housing being located one on each side of and symmetrically to the at least one material feed, said stator rings being equipped with precrushing surfaces with crushing surfaces that extend parallel to the axis of the rotor and arranged so as to be opposite to corresponding precrushing elements on the rotor, said precrushing surfaces of said stator being inclined to the axis of the rotor, said precrushing surfaces of said stator having outer regions which are inclined to the axis of the rotor;

grinding gaps being formed between said precrushing elements on the rotor and said precrushing surfaces on the stator rings, said precrushing surfaces of said stator rings and said rotor having means to adjust the spacing between the precrushing elements and precrushing surfaces so as to provide said gaps, said precrushing gaps having central and outer regions with the central regions being parallel to the axis of the rotor and the outer regions immediately followed by and merging with said central regions, said outer regions being inclined to the axis;

said stator rings of the inner walls of the housing being horizontally displaceable independently of each other and providing said means for adjusting said precrushing gaps;

said precrushing elements of said rotor being equipped with ribs of essentially axial extension;

said housing receiving said rotor being provided with two front walls on both sides of the rotor each of which wall lodging a shaft bearing for the rotor, said housing having cavities into which the material reduced within said grinding gaps immediately empty, said cavities being provided in the area of the two housing front walls in the vicinity of the shaft bearings, said cavities being provided on both sides of the rotor, said cavities being sealed steam-tight against said shaft bearings by means of special sealing units inserted in the bearing housings and placed between rotor and bearings on the side of the rotor, said cavities being provided with discharge openings for the ground material that is created by all of said precrushing and grinding surfaces and elements.

51. The drum refiner according to claim 50, wherein there is an annular material feed gap provided by an annular space enclosing the outside of the rotor within the housing, said annular space being provided approximately in said cross-axial median plane between the precrushing surfaces of said stator rings and the precrushing surfaces of the housing all of which extend parallel to the axis, said annular feed gap accepting that material that empties from said at least one material feed.

52. The drum refiner according to claim 51, wherein said at least one material feed comprises a plurality of such feeds which are individually arranged at approximately equal distances measured along the periphery of said housing.

53. The drum refiner according to claim 50, wherein said precrushing surfaces of said stator rings are equipped with ribs.

* * * * *